US005549452A

United States Patent [19]

Vogt

[11] Patent Number: 5,549,452

[45] Date of Patent: Aug. 27, 1996

[54] DOUBLE PUMP

[75] Inventor: Richard Vogt, Schwäbisch Gmünd, Germany

[73] Assignee: ZF Friedrichshafen AG, Friedrichshafen, Germany

[21] Appl. No.: 331,492

[22] PCT Filed: May 17, 1993

[86] PCT No.: PCT/EP93/01224

§ 371 Date: Nov. 1, 1994

§ 102(e) Date: Nov. 1, 1994

[87] PCT Pub. No.: WO93/24753

PCT Pub. Date: Dec. 9, 1993

[30] Foreign Application Priority Data

May 25, 1992 [DE] Germany ..... 42 17 259.4

[51] Int. Cl.[6] ..... F04B 23/08

[52] U.S. Cl. ..... 417/199.1

[58] Field of Search ..... 417/199.1

[56] References Cited

U.S. PATENT DOCUMENTS 2,512,025 6/1950 Lauck ..... 417/199.1

FOREIGN PATENT DOCUMENTS 128969 12/1984 European Pat. Off. ..... 417/199.1
3623392 2/1987 Germany .
4034267 5/1991 Germany ..... 417/199.1
4103986 8/1991 Germany ..... 417/199.1

*Primary Examiner*—Charles Freay
*Attorney, Agent, or Firm*—Davis, Bujold & Streck, P.A.

[57] ABSTRACT

The invention relates to a double pump consisting of a radial piston pump (1) and a vane-cell pump (2). The double pump is to be simplified in such a way that its over-all length is reduced and there is only one casing separation. The radial piston pump (1) has a ring insert with a molded face plate (8) fitted in an aperture (5) of the casing (4) to seal a pump set (20, 21, 22) of the vane-cell pump (1). One frontal surface (23) of the face plate, belonging to the ring insert (8), together with the casing (1) forms a dividing seam between the two pumps (1 and 2). Thus, only one annular seal (35) is needed to seal the dividing seam. The ring insert (8) with a concentric bore (36) also serves as a shaft (6) bearing and as an axial stop face (38) in the region of the eccentric (12).

6 Claims, 1 Drawing Sheet

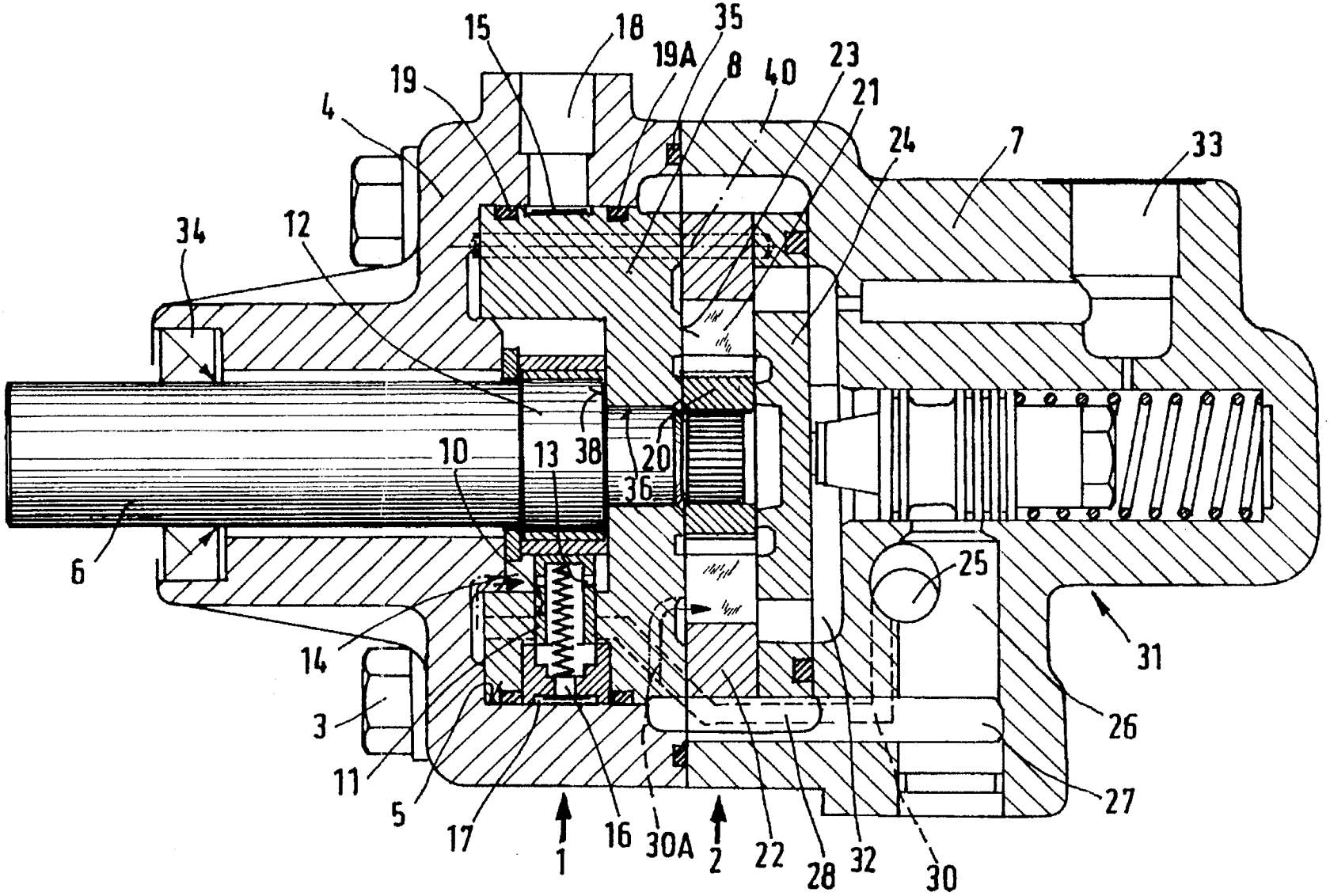
33
7
24
23
21
40
35
8
19A
18
15
19
4
12
34
6
10
13
38
36
20
31
26
27
25
30
32
28
22
2
30A
16
1
17
5
11
3
14

DOUBLE PUMP

The invention relates to a double pump consisting of a radial piston pump and a vane-cell pump combined to form a pump unit. A common shaft drives the radial piston pump situated on the input side and the vane-cell pump lying on the end of the shaft. The casing of the radial piston pump encloses a ring insert which contains the delivery piston. A pump set, consisting of a rotor, vanes and a cam ring, seals against face plates abutting on both sides of the pump set. Such double pumps are often used in motor vehicles and are driven by the vehicle engine via a V-belt. Here the radial piston pump preferably provides a level adjustment and the vane-cell pump a servo-assisted steering gear.

BACKGROUND OF THE INVENTION

A double pump of this construction has already been disclosed in DE-OS 41 03 986. For accommodation of the radial piston pump, this design has one casing which at the same time forms a face plate for the pump set of the vane-cell pump. An aperture in the casing includes a ring insert for the delivery piston. A casing lid closes said aperture. Therefore, there are at least two separations for sealing the casing containing both pump systems, namely, the separation on the casing lid and the separation between the face plate of the cup-shaped casing and the pump set of the vane-cell pump. Sealing rings are inserted in both said separations.

SUMMARY OF THE INVENTION

The problem to be solved by the invention is to structurally simplify said double pump so as to obtain a compact and weight-saving design. Besides, one separation of the casing is to be eliminated.

According to the main feature of the invention, the ring insert containing the delivery piston and the face plate for the vane-cell pump which faces the radial piston pump form a common part. By virtue of this feature, the ring insert with the face plate can be introduced into the casing of the radial piston pump together from one side and only one separation to be sealed between the two pumps remains. Besides, contrary to the prior art, the face plate molded on the ring insert is no longer part of the casing, which therefore can be made thinner. Thereby the axial length of the double pump diminishes.

According to the invention, the face plate of the ring insert has a bore for supporting the shaft. Since a special bush bearing can be eliminated, said support is less expensive.

According to the invention the ring insert in addition forms a stop face for the shaft in the area of the eccentric. A special guard ring can also be spared here.

According to the invention, it is of further advantage that only one pin is needed for securing the ring insert, the cam ring and the other face plate lying on the remote side of the radial piston pump against torsion.

According to the invention it is convenient for simpler manufacture of the contour of the frontal side to make the ring insert of sintered steel or A1 die cast metal. Said materials offer good antifriction properties together with slight wear and tear.

BRIEF DESCRIPTION OF THE DRAWINGS

An embodiment of the invention is explained in more detail with reference to the drawing showing a longitudinal section through a double pump. Since the basic structure of both pumps is generally known, it is mainly the parts essential to the invention that will be taken up herebelow.

DESCRIPTION OF THE PREFERRED EMBODIMENT

A radial piston pump 1 and a vane-cell pump 2 are joined by screws 3, spaced on the frontal surface of the casing, to form a unit. The piston pump 1 has a casing 4 with a large aperture 5. A shaft 6 extends through the casing 4 into another casing 7 of the vane-cell pump. A ring insert 8, which contains several cylindrical bores 10 for receiving delivery pistons 11, is fitted in the aperture 5 of the piston pump 1. An eccentric 12 fixed on the shaft 6 sets the delivery pistons 11 in a stroke motion. During the suction stroke, the inlet bores 13 immerse in a suction space 14 so as to fill their interior spaces with oil. During the pressure stroke, a band valve 15, which is coordinated with all the delivery pistons 11 and which curves radially outwardly from a seat over an outlet bore 16, opens ejecting oil. An annular groove 17 is connected with an outlet 18 of a first consumer. Two rings 19 and 19A lie on the outer periphery of the ring insert 8 sealing against high pressure.

A rotor 20, in a manner known per se, rests at the end of the shaft in whose slits are passed vanes 21 of the vane-cell pump 2, riding on a cam ring 22. The rotor 20, the vanes 21 and the cam ring 22 form a so-called pump set. The pump set 20, 21, 22 is sealed laterally against a frontal surface 23 and against a face plate 24. The radial piston pump and the vane-cell pump suck from a common suction pipe connection 25. Via a bore 26, a duct 27 and an annular groove 28, the oil reaches into the delivery chambers situated between the vanes 21. Besides, the suction pipe connection 25 communicates, via ducts 30 and 30A lying in another sectional plane, with the suction space 14 in which the delivery pistons 11 with the inlet bores 13 are immersed. A current-regulator valve 31 lies concentrically in relation to the shaft 6 behind the face plate 24. Said current-regulator valve 31 governs, in a manner known per se, part of the delivery current of the vane-cell pump, which increases with the speed, into the bore 26 communicating with the suction pipe connection 25. The useful current flows to a second consumer from a pressure space 32 via another outlet 33.

According to the invention, a face plate which forms the frontal surface 23 is molded on the ring insert 8. The frontal surface 23, together with the casing 4, provides the only separation from the vane-cell pump 2. Therefore, in addition to a shaft sealing ring 34 on the input side of the radial piston pump, only a single annular sealing 35 is needed on the lower pressure side. Therefore, parts and_ assembly time can be saved. A concentric bore 36 in the ring insert 8 supports the shaft 6 without an additional bush bearing. The shaft 6 is axially supported on a stop face 38 of the ring insert 8. The additional installation of an otherwise customary stop disc can be eliminated. The ring insert 8 is preferably made of a material having good antifriction and abrasive properties such as A1 die cast metal or sintered metal. As indicated with a dotted central line 40, a pin which penetrates the ring insert 8, the cam ring 22 and the face plate 24 secures the parts of the pump against torsion.

For assembling the double pump, the shaft 6 is inserted in the bore 36 of the ring insert 8 which is preassembled with the delivery pistons 11 and the sealing rings 19 and 19A. Said assembled unit is then inserted into the casing 4. The pre-assembled pump set 20, 21, 22 is then slipped on the shaft stub of the shaft 6 projecting from the ring insert 8 or the casing 4. After pre-assembling the current-regulating valve 31 in the casing 7 and after inserting the face plate 24, the casing 7 can be mated with the casing 4 and screwed therewith.

I claim:

1. A double pump having the following features:

a radial piston pump (1) and a vane-cell pump (2) being combined to form a pump unit;

a common shaft (6) driving both said pumps;

a casing (4) of said radial piston pump (1) enclosing a ring insert (8) containing delivery pistons (11) of said piston pump;

said vane-cell pump (2) comprising a pump set including a rotor (20), a plurality of vanes (21) and a cam ring (22) sealed against a pair of face plates (24) abutting on both sides of said pump set, wherein said ring insert (8) and said face plate (frontal surface 23) of said pump set facing said radial piston pump (1) form a common part.

2. A double pump according to claim 1, wherein said ring insert (8) has a bore (36) concentric with a bearing of said shaft (6).

3. A double pump according to claim 1, wherein, in a region of an eccentric (12) of said radial piston pump (1), said ring insert (8) forms a stop face (38) of said shaft (6).

4. A double pump according to claim 1, wherein a pin (40) penetrates said ring insert (8), said cam ring (22) and said face plate (24) remote fro msaid radial piston pump to secure those components against torsion.

5. A double pump according to claim 1, wherein said ring insert (8) is made of sintered metal.

6. A double pump according to claim 1, wherein said ring insert (8) is made of A1 die cast metal.

* * * * *